US011767667B2

(12) United States Patent
Ballew

(10) Patent No.: US 11,767,667 B2
(45) Date of Patent: Sep. 26, 2023

(54) MODULAR DYNAMIC BUILDING STRUCTURE AND METHOD FOR CONFIGURING THE SAME

(71) Applicant: TRADECRAFT INDUSTRIES LLC, Denver, CO (US)

(72) Inventor: Bryce W. Ballew, Denver, CO (US)

(73) Assignee: Tradecraft Industries LLC, Denver, CO (US)

( * ) Notice: Subject to any disclaimer, the term of this patent is extended or adjusted under 35 U.S.C. 154(b) by 468 days.

(21) Appl. No.: 16/888,487

(22) Filed: May 29, 2020

(65) Prior Publication Data

US 2020/0378108 A1 Dec. 3, 2020

Related U.S. Application Data

(60) Provisional application No. 62/856,094, filed on Jun. 2, 2019.

(51) Int. Cl.

| | |
|---|---|
| ***E04B 1/348*** | (2006.01) |
| ***E04B 1/35*** | (2006.01) |
| ***E04B 1/18*** | (2006.01) |
| ***E04H 1/00*** | (2006.01) |
| *G06Q 50/08* | (2012.01) |

(52) U.S. Cl.

CPC ..... *E04B 1/34807* (2013.01); *E04B 1/18* (2013.01); *E04B 1/35* (2013.01); *E04H 1/005* (2013.01); *E04B 2001/3588* (2013.01); *G06Q 50/08* (2013.01)

(58) Field of Classification Search

CPC ..... E04B 1/18; E04B 1/35; E04B 1/34807; E04B 2001/3588; E04H 1/005

See application file for complete search history.

(56) References Cited

U.S. PATENT DOCUMENTS 2,499,498 A * 3/1950 Hammond, Jr. ..... E04H 1/005 414/277
3,866,672 A * 2/1975 Rich, Jr. ..... F24F 3/044 165/50
4,599,829 A 7/1986 DiMartino, Sr.
(Continued)

FOREIGN PATENT DOCUMENTS

CZ 196394 A3 2/1995
CZ 240296 A3 12/1996
(Continued)

OTHER PUBLICATIONS https://stackhouse.life/, Stackhouse, Movable, Luxury Housing, Small Business Website, 2020.

*Primary Examiner* — Christine T Cajilig
(74) *Attorney, Agent, or Firm* — AKERMAN LLP

(57) ABSTRACT

A modular dynamic building system includes a superstructure and a container. The superstructure includes: a plurality of columns; a plurality of beams connected to the columns to form an opening into the superstructure; and a plurality of tracks connected to the superstructure and in the opening. The container includes an opening in one side thereof and a plurality of wheels connected to a bottom surface of the container. The wheels of the container are on the tracks of the superstructure, and the opening in the container faces into the superstructure.

18 Claims, 19 Drawing Sheets

(56) References Cited

U.S. PATENT DOCUMENTS

| | | | | |
|---|---|---|---|---|
| 4,766,708 | A * | 8/1988 | Sing | E04B 1/98 52/167.2 |
| 4,802,500 | A | 2/1989 | Davis et al. | |
| 9,663,937 | B2 * | 5/2017 | Goldman | E04B 1/3483 |
| 10,711,476 | B2 * | 7/2020 | Ansari | E04B 1/34807 |
| 2003/0101680 | A1 * | 6/2003 | Lee | E04H 3/02 52/745.2 |
| 2016/0312485 | A1 * | 10/2016 | Wilson | E04B 5/48 |
| 2017/0350113 | A1 * | 12/2017 | Fernandes | E04B 1/38 |
| 2019/0100934 | A1 * | 4/2019 | Ansari | E04H 5/02 |
| 2019/0119903 | A1 * | 4/2019 | Rebeil | E04B 1/36 |

FOREIGN PATENT DOCUMENTS

| | | | |
|---|---|---|---|
| DE | 1784978 | A1 * | 11/1971 |
| DE | 102011109102 | A1 * | 2/2013 |
| EP | 0639677 | A1 | 2/1995 |
| EP | 0817893 | A1 | 1/1996 |
| FR | 2588 302 | | 4/1987 |
| GB | 1308221 | A * | 2/1973 |
| WO | WO9527107 | A1 | 10/1995 |

* cited by examiner

MODULAR DYNAMIC BUILDING STRUCTURE AND METHOD FOR CONFIGURING THE SAME

CROSS-REFERENCE TO RELATED APPLICATION

The present application claims priority to and the benefit of U.S. Provisional Patent Application Ser. No. 62/856,094, filed on Jun. 2, 2019, the content of which is incorporated herein by reference in its entirety.

BACKGROUND

1. Field

Aspects of embodiments of the present disclosure are related to a modular dynamic building system and a method for configuring the same.

2. Related Art

Recently, a trend of people moving from rural locations into cities has increased. It is believed that over 50% of people in the world live in cities. This trend, coupled with an ever increasing population, has drastically increased the need for residential real estate in cities, especially the more space-efficient multi-family buildings and so-called mixed-use properties, which include both commercial and residential spaces. But given the usually strict building codes in cities, tight confines, little available and unused land, etc., it can take many years to build a new large building. In addition, once the building is complete, it cannot easy be re-modeled or reconfigured.

Further, there is another trend of people seeking to recreate the urban feel but without the traffic, congestion, pollution, and other negative attributes of urban living. Thus, there is a desire to create urban-like (or urban-feel) communities outside large cities that provide the convenience of urban living, such as easy walkability, access to various stores, a sense of community, etc. but without (or while minimizing) the negative attributes of urban living.

In addition, the world has recently seen the need to be able to rapidly build safe but temporary buildings, such as hospitals and the like. Typically, temporary structures that are built rapidly suffer from building (or contractor) defects due to errors, oversights, and corner-cutting, or have a short building lifespan due to their inflexibility to be reconfigured for changing needs.

SUMMARY

According to embodiments of the present disclosure, a modular dynamic building system is provided that allows for easy configuration and reconfiguration of units (e.g., living spaces, working spaces, hospital rooms, etc.) in a semi-permanent or permanent superstructure. The units include one or more containers that are configured to be wheeled into and out of the superstructure horizontally and are configured to be easily connected to common utilities once installed in the superstructure. As such, a cheap, rapidly constructed building that can be largely constructed in units off-site and which may be adapted quickly for changing needs is provided.

According to an embodiment of the present disclosure, a modular dynamic building system includes a superstructure and a container. The superstructure includes: a plurality of columns; a plurality of beams connected to the columns to form an opening into the superstructure; and a plurality of tracks connected to the superstructure and in the opening. The container includes an opening in one side thereof and a plurality of wheels connected to a bottom surface of the container. The wheels of the container are on the tracks of the superstructure, and the opening in the container faces into the superstructure.

The modular dynamic building system may further include a crane on a roof of the superstructure; and a carriage suspended by the crane. The carriage may be removably connectable to the superstructure.

The carriage may include a plurality of tracks, and the tracks on the carriage correspond to the tracks in the opening of the superstructure.

The modular dynamic building system may further include a plurality of track extensions. The track extensions may be configured to extend the tracks on the carriage to the tracks in the opening of the superstructure.

The container may include: a plurality of columns; a plurality of beams; an outer skin covering the columns and beams of the container; and an inner skin on an inner surface of the columns and beams of the container.

The container may be 24 feet long and 9 feet high.

The modular dynamic building system may further include a second container. The container is a first container, and each of the first container and the second container may have an open side. The open sides may face each other in an installed configuration in the superstructure.

The modular dynamic building system may further include a connected space between the open side of the first container and the open side of the second container.

The connected space may have a floor, wall panels, and a ceiling.

The first container, the second container, and the connected space may together form a single, continuous space.

According to another embodiment of the present disclosure, a method for configuring a modular dynamic building system is provided. The method includes: moving a container onto a carriage; lifting the container with the container thereon via a crane to be adjacent an opening in a superstructure; moving the container from the carriage into the superstructure; and locking the container to the superstructure.

The crane may be on a roof of the superstructure.

The method may further include attaching a plurality of insulating panels around exterior edges of the container in the superstructure.

The container may include a plurality of wheels, and the carriage may include a plurality of corresponding tracks into which the wheels of the container fit.

The method may further include installing a second container into the superstructure at a second opening in the superstructure adjacent to the opening.

The method may further include installing a floor, walls, and a ceiling into a space between the container and the second container.

The container may have an opening into the superstructure.

Both the container and the second container may include utilities under an inner skin of the container and of the second container.

The method may further include connecting the utilities of the container to building-wide utilities in the superstructure.

The method may further include removing the container from the superstructure.

DETAILED DESCRIPTION

Figure 1A:
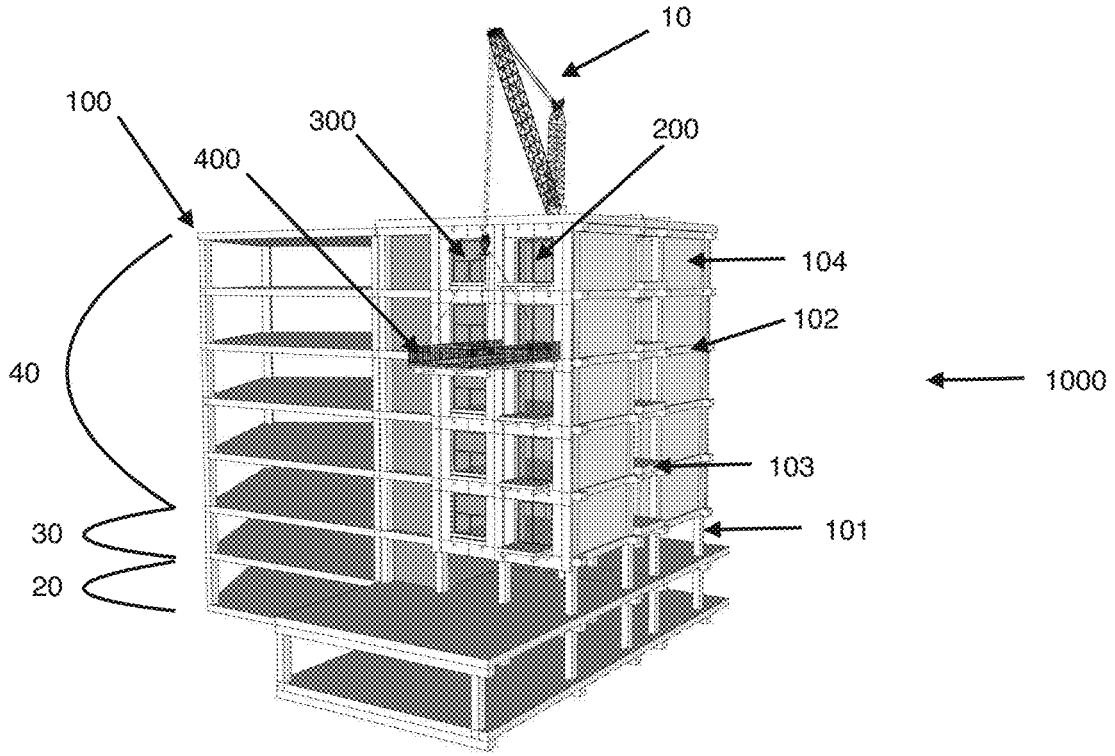
FIG. 1A is a perspective view of a modular dynamic building structure according to an embodiment of the present disclosure.

Hereinafter, example embodiments of the present disclosure will be described, in more detail, with reference to the accompanying drawings. The present disclosure, however, may be embodied in various different forms and should not be construed as being limited to only the embodiments illustrated herein. Rather, these embodiments are provided as examples so that this disclosure will be thorough and complete and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

It will be understood that, although the terms "first," "second," "third," etc., may be used herein to describe various elements, components, and/or layers, these elements, components, and/or layers should not be limited by these terms. These terms are used to distinguish one element, component, or layer from another element, component, or layer. Thus, a first element, component, or layer described below could be termed a second element, component, or layer without departing from the scope of the present disclosure.

It will be understood that when an element or component is referred to as being "connected to" or "coupled to" another element or component, it may be directly connected or coupled to the other element or component or one or more intervening elements or components may also be present. When an element or component is referred to as being "directly connected to" or "directly coupled to" another element or component, there are no intervening element or component present. For example, when a first element is described as being "coupled" or "connected" to a second element, the first element may be directly coupled or connected to the second element or the first element may be indirectly coupled or connected to the second element via one or more intervening elements.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components but do not preclude the presence or addition of one or more other features, integers, steps, operations, elements, components, and/or groups thereof. That is, the processes, methods, and algorithms described herein are not limited to the operations indicated and may include additional operations or may omit some operations, and the order of the operations may vary according to some embodiments. As used herein, the term "and/or" includes any and all combinations of one or more of the associated listed items.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "example" is intended to refer to an example or illustration.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIGS. 1A-1C, 6, and 7 show a modular dynamic building structure 1000 (later referred to herein as the "building 1000") with a crane 10 on a roof thereof according to an embodiment of the present disclosure, and FIGS. 2A-2D show one continuous space (e.g., one living unit) of the modular dynamic building structure 1000 shown in FIGS. 1A-1C, 6, and 7.

Figure 1B:
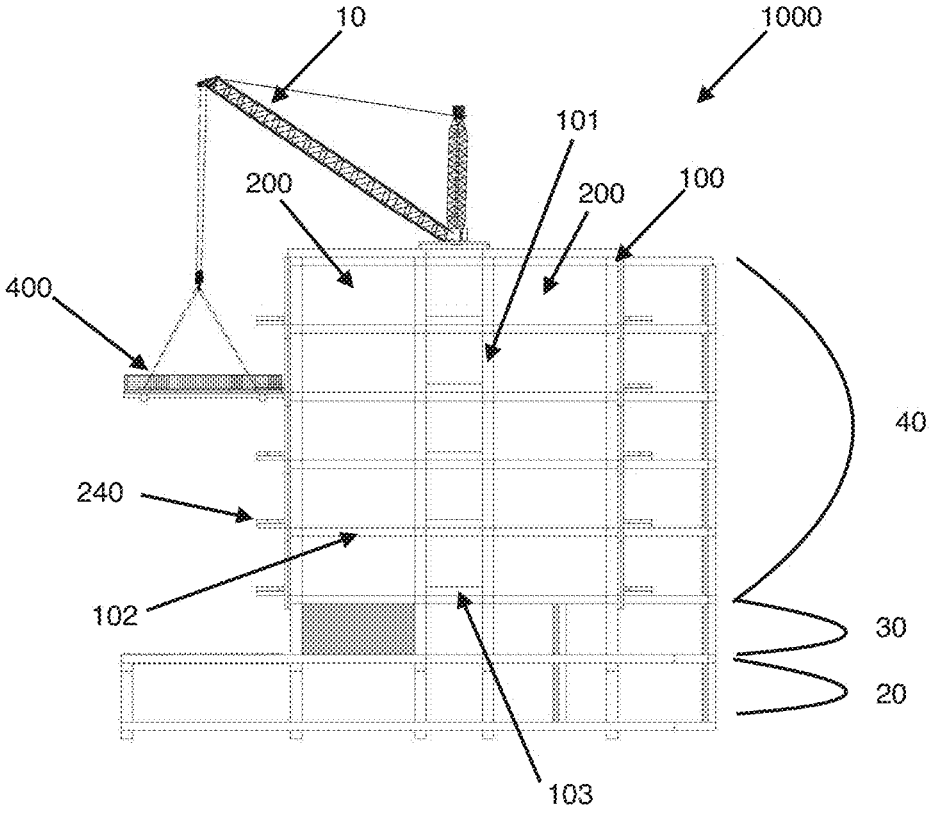
FIG. 1B is a cross-sectional view of the modular dynamic building structure shown in FIG. 1A.

Referring to FIGS. 1A and 1B, the modular dynamic building structure 1000 has a subterranean level (e.g., a subterranean service level) 20, a retail level 30, and a plurality of modular residential levels 40 on the retail level 30. The terms used to identify the various levels 20, 30, and 40 are merely examples, and the present disclosure is not limited to these configurations. For example, some embodiments of the present disclosure may omit the subterranean level 20. Further, the subterranean level 20 may be used for various purposes, such as for deliveries, utilities, waste collection, etc., or may be used as a parking structure, for tenant storage, etc. Similarly, the retail level 30 may be omitted in some embodiments or may be a lobby level when the modular dynamic building structure 1000 is an office building or a hospital, etc. In some embodiments, the modular residential levels 40 may be modular office levels of an office building, modular patient levels in a hospital, etc.

Figure 1C:
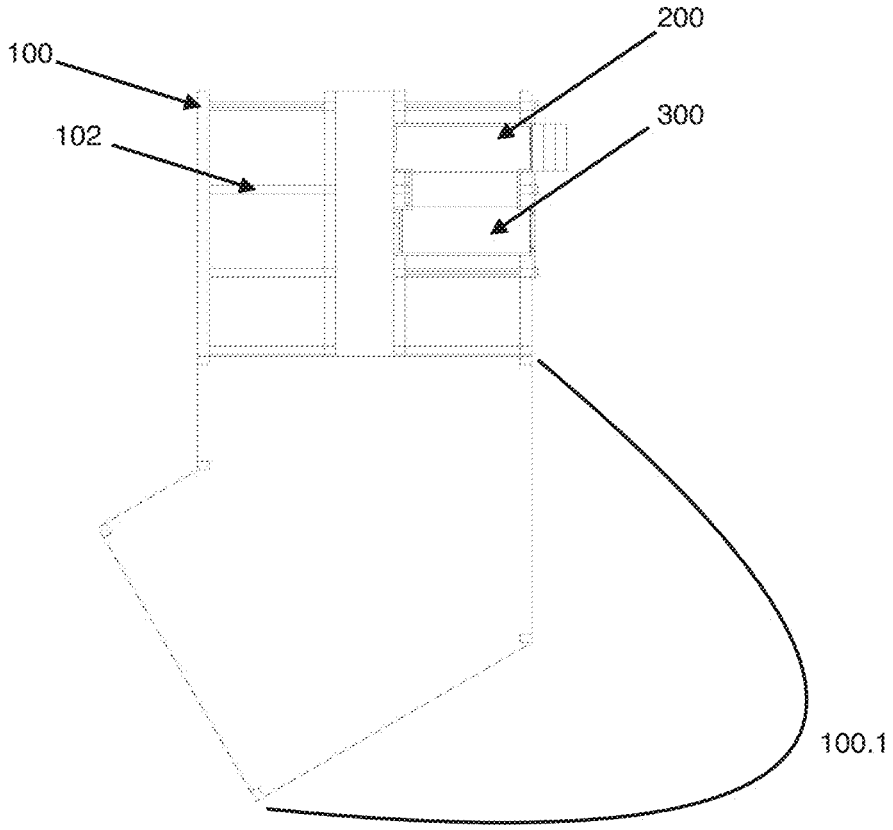
FIG. 1C is a cross-sectional view of a residential floor of the modular dynamic building structure shown in FIGS. 1A and 1B.

Referring to FIGS. 1A-1C, the modular dynamic building structure 1000 includes a permeant or semi-permanent superstructure 100. The superstructure 100 includes columns 101 and beams 102 perpendicular or substantially perpendicular to the columns 101. The columns 101 and beams 102 are connected to each other using any suitable connection method, such as nut and bolt, welding, etc. The columns 101 and beams 102 may be steel, wood, or any other suitable building material in consideration of the overall height of the building and the intended use of the building. Although the columns 101 and beams 102 are shown as having square or rectangular cross-sectional shapes, but the present disclosure is not limited thereto. In other embodiments, the columns 101 and beams 102 may be I-beams, H-beams, etc. The columns 101 and beams 102 of the superstructure 100 are primarily assembled on site, although in some embodiments, parts of the superstructure 100 are assembled off-site and transported to the building location.

In some embodiments, the retail level 30 may be built out as a conventional space (e.g., with insulation, drywall, etc.) to provide one or more large open spaces, such as a building lobby, public sitting areas, cafeteria, etc. The residential levels 40, however, may include both common space areas 100.1 and a plurality of containers 200, 300 (e.g., a first container 200 and a second container 300). The common space areas 100.1 are more permanent structures and may configured as trash rooms, utility rooms, stairs, elevators, and common area rooms, such as game rooms, laundry room, gardens, study areas, etc. The common spaces areas 100.1 may be fabricated offsite and installed into the superstructure 100 on-site, or may be built using conventional building processes as described above.

The containers 200, 300 are removably mounted to (or mounted in) the superstructure 100. As described in more detail below, two (or more) of the containers 200, 300 may be connected to each other and open to each other to define a single, continuous space (e.g., a living space, hospital room, office, etc.). However, the continuous space including (or formed by) two containers 200, 300 is merely an example. As described below, a single, continuous space may include (or may be formed by) only a single container (e.g., in a hospital configuration) or three or more containers (e.g., to provide larger continuous spaces, such as a penthouse-style living space).

The crane 10 on the superstructure 100 may be utilized to install and remove the containers 200, 300 from the residential levels 40 of superstructure 100 via a carriage 400 (described below in more detail). The crane 10 may be counterbalanced by the superstructure 100. For example, one or more of the columns 101 may extend through the roof and may act as an attachment point for the crane 10 to counterbalance the weight of the carriage 400 with weight of the container 200, 300.

The crane 10 may be on a track, allowing it to move back-and-forth along the superstructure 100, and the track may be circular or semi-circular to allow the crane 10 to access both sides of the superstructure 100 to install and remove two or more columns of containers 200, 300 in the superstructure 100. In other embodiments, the crane 10 may be rotatable to access both sides of the superstructure 100. In some embodiments, the crane 10 may be a conventional crane that moves independently on the superstructure 100.

Referring to FIGS. 2A-2D, a portion of the modular dynamic building structure 1000 including one continuous space including (or formed by) two containers 200, 300 is illustrated. As described in more detail below, the containers 200, 300 shown in FIGS. 2A-2D may be connected to each other and open to each other to define a single, continuous space. Further, the building 1000 includes a plurality of connected containers, and the two containers 200, 300 are merely described as an example. For example, the building 1000 may include tens or hundreds of containers connected to each other in various arrangements.

Due to the modular nature of the modular dynamic building structure 1000, connection points between the columns 101 and beams 102 may be pre-formed or pre-indicated to speed on-site construction. For example, referring to FIG. 2C, adjacent ones of the columns 101 may be spaced apart from each other by a distance Di of about 14 feet, 6 inches, but this is merely an example. Thus, since the spacing between columns 101 is known and common or substantially common, openings (or holes) may be formed or drilled into the columns 101 and beams 102 at where they are to be connected to each other. This can allow a construction crew to reduce time spent measuring, cutting, drilling, etc. the columns 101 and beams 102 on site, further speeding construction of the superstructure 100.

The superstructure 100 may include removable flooring 103 spanning a space between two or more adjacent beams 102 to form a hallway. Under the flooring 103, common utilities, such as electrical, water, sewer, internet, etc. may be run from an outside connection to each continuous space (e.g., to one of the containers 200, 300, which then shares the connections with the other one of the container 200, 300) or separately to both containers 200, 300.

Similar to the connection between the columns 101 and beams 102, the flooring 103 and beams 102 may be pre-configured with openings (or holes) to allow for quick and accurate connection between the flooring 103 and the beams 102. Further, the commonality between components (e.g., between sizing, spacing, etc.) allows for the off-site manufacture of common components, reducing cost and increasing speed.

The superstructure 100 may further include a fascia that is exposed to the outside of the modular dynamic building structure 1000. The fascia may include both permanent or semi-permanent panels 111, removeable panels 112, 113, and track covers 112.1. The panels 111, 112, 112.1, 113 may together provide weathertightness, insulation, and decoration. As described below in more detail, the containers 200, 300 do not have substantial insulation to reduce cost and weight, and instead, the containers 200, 300 rely on the insulating features of the panels 111, 112, 112.1, 113 to regulate temperature, prevent water intrusion, etc.

The panels 111 may be installed on the superstructure 100, for example, on the exterior columns 101 and/or beams 102 of the superstructure 100 before the containers 200, 300 are installed. However, the present disclosure is not limited thereto, and in other embodiments, the panels 111 may be installed onto the superstructure 100 after the containers 200, 300 are installed.

After the containers 200, 300 are installed, the panels 112, 112.1, 113 are installed onto the columns 101 and/or beams 102 and cover gaps between the superstructure 100 and the containers 200, 300. The panels 112, 112.1, 113 also cover the installation mechanisms (e.g., tracks) and/or utility equipment under the containers 200, 300. For weathertightness, the panels 112, 112.1, 113 may be installed behind (e.g., partially behind) the panels 111.

Each of the panels 111, 112, 112.1, 113 may have an R value of about 19 to about 30. For example, the panels 111, 112, 112.1, 113 may include foam or fiberglass cores surrounded by a metal or plastic body. Further, the panels 111, 112, 112.1, 113 may have a design (or a part of larger design) painted, printed, or wrapped (e.g., vinyl wrapped) thereon so that the final modular dynamic building structure 1000 has a pleasing aesthetic appearance without needing to be painted or wrapped (e.g., vinyl wrapped) after all of the containers are installed, thereby removing another time consuming and expensive aspect of conventional construction and allowing for easy changing of the exterior design.

Figure 2A:
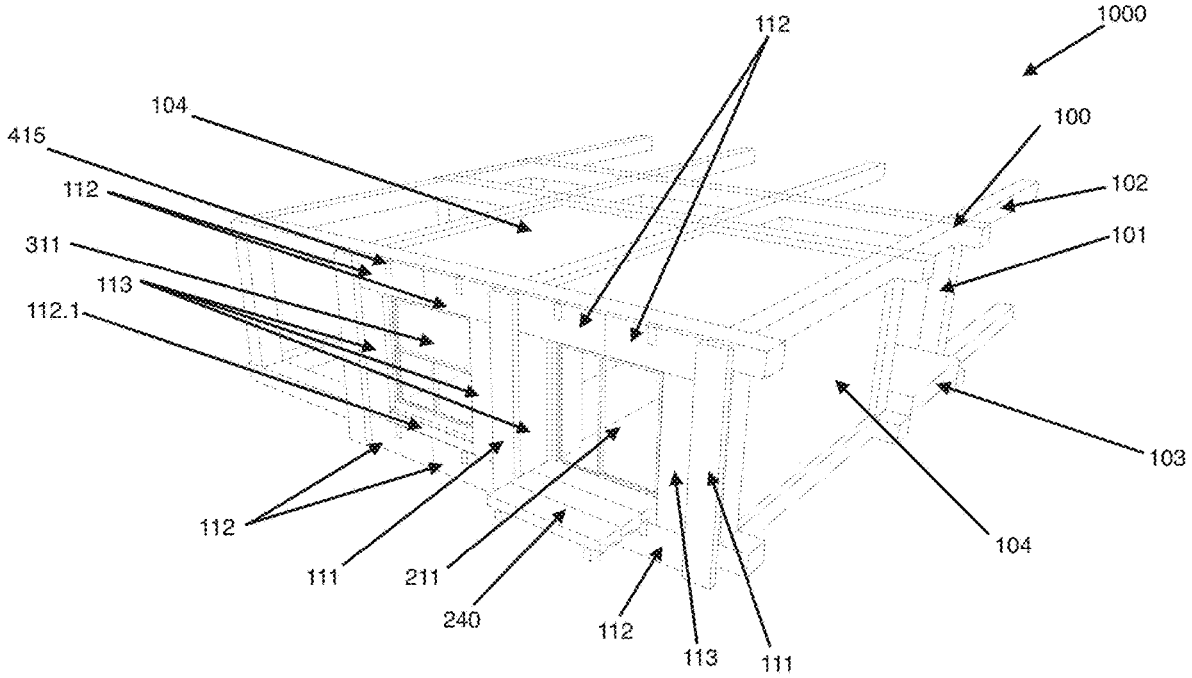
FIG. 2A is perspective view of two containers forming one continuous space of the modular dynamic building structure shown in FIGS. 1A-1C according to an embodiment of the present disclosure.
Figure 2B:
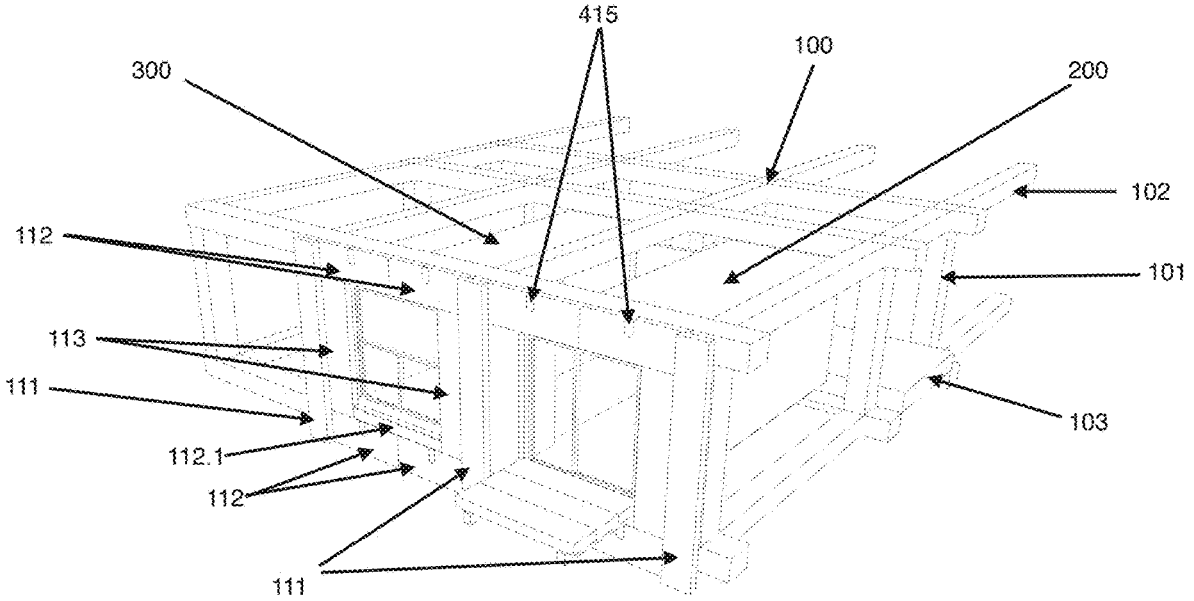
FIG. 2B is the same as FIG. 2A but omits separation panels to show underlying components.

In FIG. 2A, separation panels 104 are shown while they are omitted in FIG. 2B to show underlying components. The separation panels 104 are fire rated panels that fill the space between the columns 101 and beams 102 to separate different connected containers 200, 300 from each other. For example, each connected set of containers 200, 300 may be surrounded on top, bottom, and lateral sides by the separation panels 104. In some embodiments, the separation panels 104 may also be included at longitudinal sides of the connected containers 200, 300 with corresponding cutouts for windows, doors, etc.

The separation panels 104 may be prefabricated (e.g. may be manufactured offsite to common dimension) and may provide sound isolation and fire rating between floors and between connected containers 200, 300. Also, in some embodiments, the separation panels 104 may have permanent utilities, such as fire suppression, fire alarms, and smoke detection built therein. For example, the separation panels 104 may be structural insulated panels.

In some embodiments, the containers 200, 300 may have an opening in an upper surface thereof such that the upper separation panel 104 acts as the ceiling of the below containers 200, 300. In such an embodiment, continuous space in the containers 200, 300 is increased by providing additional height.

Figure 2C:
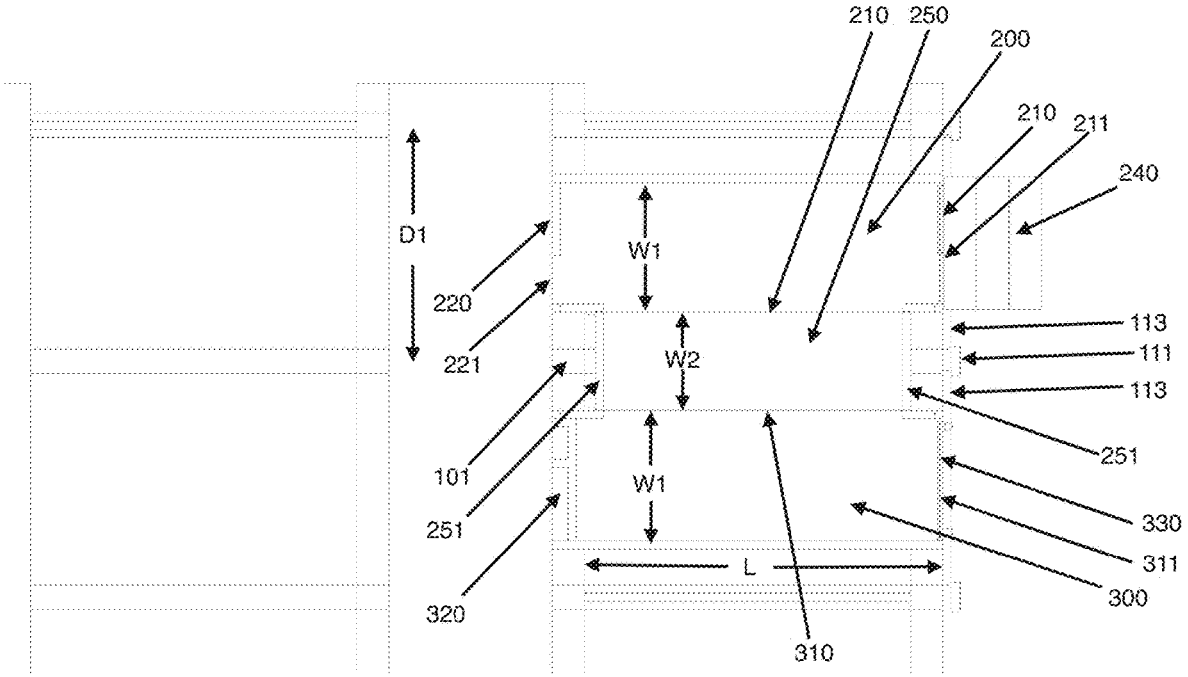
FIG. 2C is a top-down schematic view the two containers shown in FIGS. 2A and 2B.
Figure 2D:
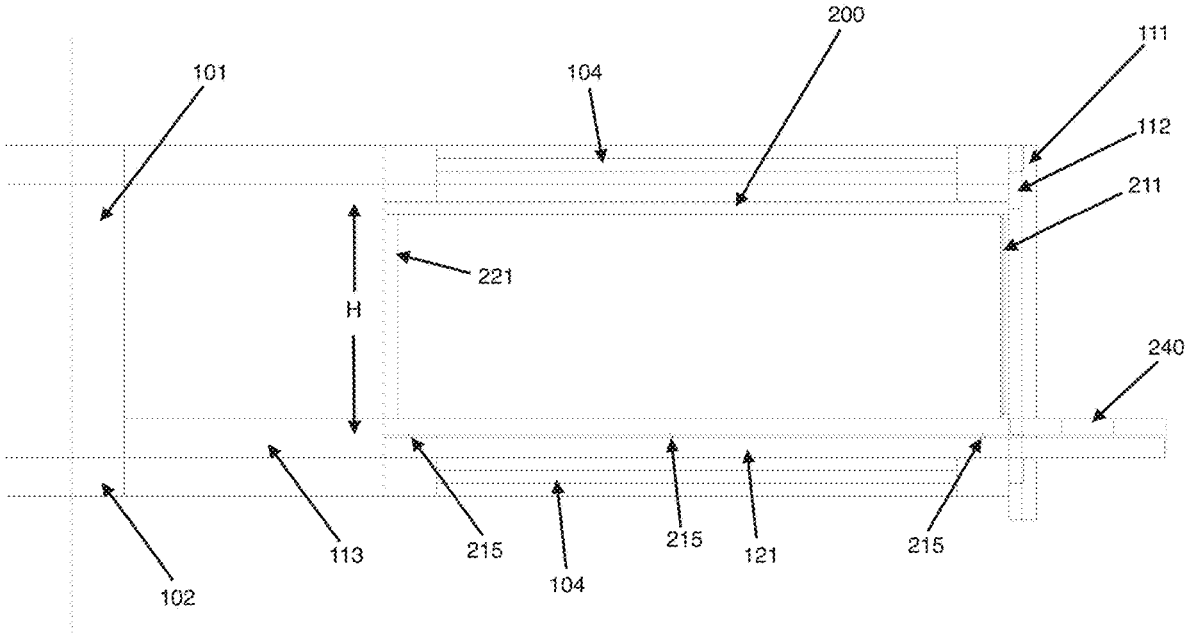
FIG. 2D is a cross-sectional schematic view of a first container shown in FIGS. 2A-2C.
Figure 3:
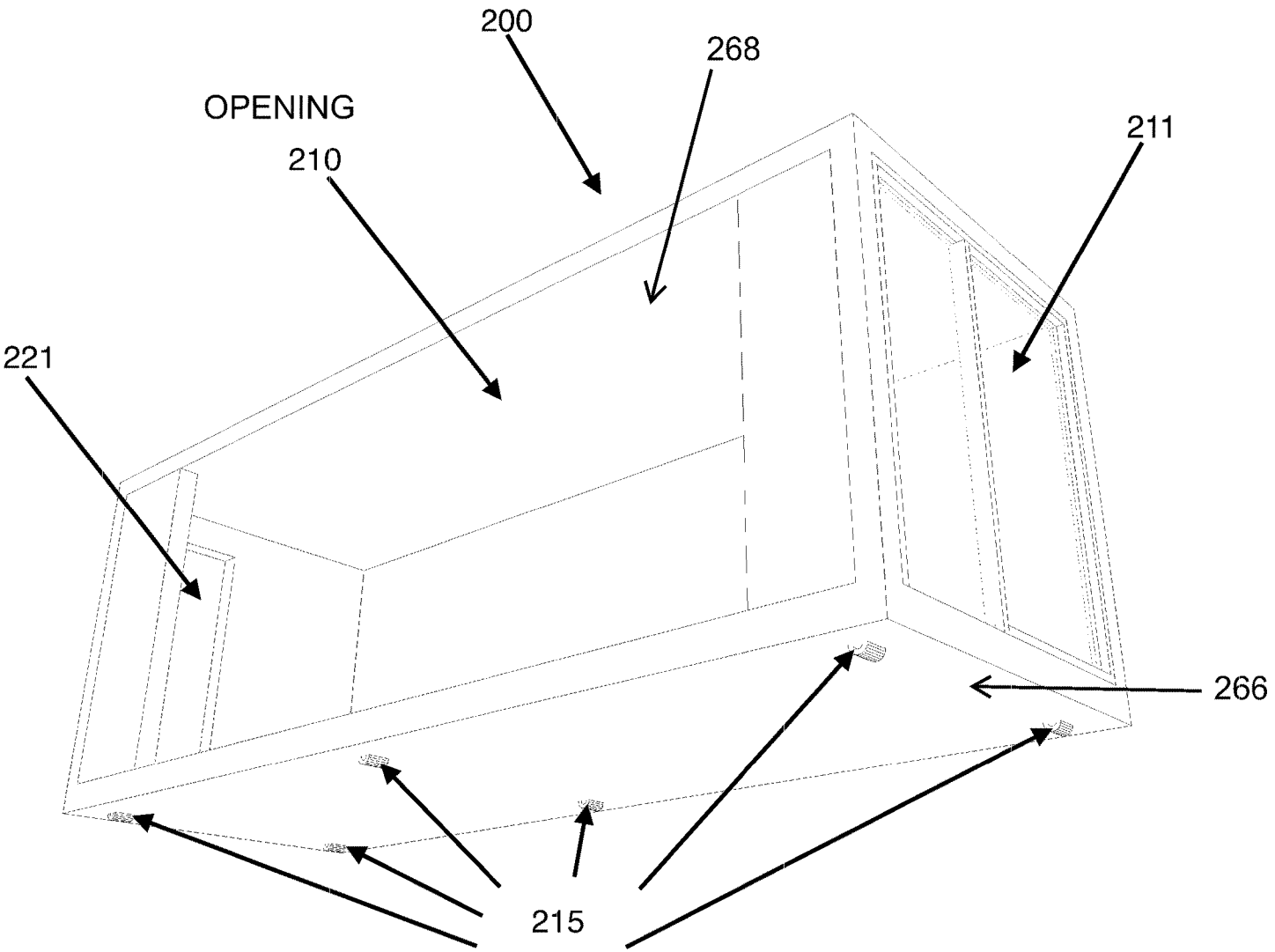
FIG. 3 is a schematic perspective view of the first container shown in FIGS. 2A-2D.

FIGS. 2C and 2D are schematic views showing inside the containers 200, 300 from different perspectives, and FIG. 3 shows a bottom perspective view of the container 200. The containers 200, 300 may have external dimensions of a typical shipping container, such as about 24 feet long (L in FIG. 2C), about 8 feet, 6 inches wide ($W_1$ in FIG. 2C), and about 9 feet high (H in FIG. 2D), but the present disclosure is not limited thereto. The overall dimensions of the containers 200, 300 are not particularly limited; however, the containers 200, 300 should be sized to be easily transported via ship, train, tractor-trailer, airplane, etc. for ease of transport. For these reasons, using standard shipping container dimensions for the containers 200, 300 may provide for ease of transportation by utilizing an existing transportation infrastructure.

Because the containers 200, 300 do not include substantial (or any) insulation themselves, instead relying on other panels for insulation, the interior dimensions of the containers 200, 300 may only be slightly smaller than their outer dimensions, thereby maximizing usable space. For example, the interior dimensions of the containers 200, 300 may be about 8 feet wide, 23 feet, 6 inches long, and 8 feet, 6 inches high. For example, each wall may be about 3 inches thick, which accounts for structural material (e.g., steel, aluminum, or another suitable material) and interior-facing panels (e.g., melamine panels, etc.).

Each of the containers 200, 300 may have an opening 210, 310 in at least one of the sides thereof. The openings 210, 310 may be in sides (e.g., long sides) of the respective containers 200, 300 that face each other in an installed configuration. In this way, the total usable space is increased by connecting (e.g., internally connecting) the containers 200, 300 inside the superstructure 100. For example, a connected space 250 between the two containers 200, 300 may be finished by installing flooring, wall panels, and a ceiling after the containers 200, 300 are installed in the superstructure 100. The connected space 250 may have a width W2 of about 6 feet.

The flooring, wall panels, and ceiling in the connected space 250 is installed after the containers 200, 300 are mounted to the superstructure 100.

While a continuous space including only two containers 200, 300 is shown in the FIGS. 2A-2D, the present disclosure is not limited thereto. In other embodiments, three or more containers may be connected and open to each other to provide an even larger continuous space. In such an embodiment, the outer containers would have an opening in one long side thereof while the interior container or containers would have openings in two opposite long sides thereof to provide two or more connected spaces.

Hereinafter, the containers 200, 300 will be described in more detail with respect to FIGS. 2A-3.

Each of the containers 200, 300 has at least six sides—a top, a bottom, two parallel long sides, and two parallel short sides. The top, bottom, and long sides may primarily extend (e.g., have a longest or largest dimension in) a length direction of the respective container 200, 300. The short sides may primarily extend in a width direction of the respective container 200, 300. An opening (e.g., an open or substantially open side) 210, 310 may be formed in at least one of the long sides of the containers 200, 300. When a continuous space includes two containers 200, 300, the openings 210, 310 face each other in an installed configuration (e.g., when the containers 200, 300 are installed in the superstructure 100). When the continuous space includes three or more containers, the outermost containers will have one open side facing the other containers of the continuous space while the interior (or inner) containers will have two open sides in the long sides to be open to adjacent containers in both directions.

For convenience, features common to the containers 200, 300 will be described below with reference to only the container 200, but these features should be understood as being applicable to all of the containers, and repeated description of features will be omitted.

The container 200 may have an aluminum (or other metal) frame with interior and/or exterior fascia panels covering the frame. For example, unlike conventional shipping containers, which are generally solid steel (or metal) boxes, the container 200 has a column and beam (e.g., stud-type) construction, similar to how buildings are typically built. In this way, the amount of material required for the container 200 is reduced and, importantly, the weight of the container 200 is also reduced. An outer skin 266 may be an aluminum panel to cover the exposed frame, while an inner skin 268 (e.g., walls and ceiling) may be, for example, melamine as that is what occupants would be accustomed to. Similarly, a floor of the container 200 may be hardwood, laminate, tile, etc. as occupants would be accustomed to. A plurality of wheels 215 may be arranged under the container 200 for installation into and removal from the superstructure 100 (described below in more detail).

The container 200 may not include any substantial insulation. For example, the space between the inner and outer skin of the container 200 may be empty (e.g., filled with air) rather than filled with an insulating material (e.g., fiberglass insulation) as in traditional building construction. In this way, the cost of the container 200 can be reduced, while the panels 111, 112, 112.1, 113 on the outer side of the superstructure 100 provide thermal insulation and weathertightness.

Various electrical, plumping, Internet, and other utilities connections may be arranged between the outer skin and the inner skin (e.g., the floor, walls, and ceiling) of the container 200. For example, the container 200 may be plumbed and wired (for electrical, lighting, ethernet, etc.) before the outer skin and floor, walls, and ceiling are installed. Further, external utilities connection may all be provided under the floor at the short side 220 of the container 200 facing into the superstructure 100. For example, quick connect plumbing, electrical, internet, etc. connections may all be provided at the same side of the container 200 for quick and relatively easy connection with building-wide systems. For example, the building 1000 may provide the container 200 (e.g., each of the containers 200, 300) with fresh water, mains electrical service (e.g., 100 amp or 200 amp service into a distribution panel), Internet in the form of a gigabit ethernet (or other similar interfaces), cable TV via coaxial cable, waste water outlet, fire protection systems (e.g., connection to a building-wide fire protection system), one or more fire alarms, etc. In building the superstructure 100, the corresponding utilities may be installed under the removable flooring 103.

Further, the short side 220 of the container 200 facing into the superstructure 100 may include an opening (e.g., a doorway, entryway, or door) 221. In some embodiments, the container 300, which is internally connected to the container 200 via the connected space 250, may not have a door at the short side 320 thereof facing into the superstructure 100 to increase usable (or livable) space. However, when the continuous space includes of three or more containers, one or more of the containers may include a door at the short side facing into the superstructure 100 to provide additional ingress/egress points for improved convenience and safety.

For example, the container 200 that includes the door 221 into the superstructure 100 (e.g., into a hallway within the superstructure 100) may be configured as a living room and/or kitchen, and the container 300 that is internally connected to the container 200 but does not have a door open into the superstructure 100 may be configured as a bedroom. In such a configuration, an additional door may be installed between the containers 200, 300 (e.g., in or adjacent to the connected space 250) to provide additional privacy to an occupant in the container 300 configured as a bedroom.

The short side 230 of the container 200 facing away from the superstructure 100 may be configured as a wall with a window (see, e.g., window 311 in the container 300 as shown in FIG. 2A) or, when the container 200 additionally has a balcony 240, a sliding glass door 211 or the like to provide access to the balcony 240. In some embodiments, the short side 230 of the container 200 may be a large glass (or plastic, etc.) window that spans the entire short side 230 to provide a "panoramic" window and compensates for the lack of other windows in the container 200.

The interiors of the containers 200, 300 may be variously configured in function, style, organization, level of completeness, etc. For example, some occupants may choose to purchase a relatively sparse container and purchase and install appliances, furniture, etc. of their choosing. In other cases, occupants may choose to purchase complete containers with appliances pre-installed. Similarly, the containers 200, 300 may be sold pre-designed with paint, wallpaper, furniture, flooring (e.g., carpet, etc.) or may be sold without these elements so that the occupant can design the container as they see fit.

Hereinafter, steps of a method for configuring the modular dynamic building structure 1000 will be described with reference to FIGS. 4A-4G and FIG. 5. For example, FIGS. 4A-4G show steps of installing the container 300 into the superstructure 100. A similar or the same method may be used to install the container 200 into the superstructure 100.

Figure 4A:
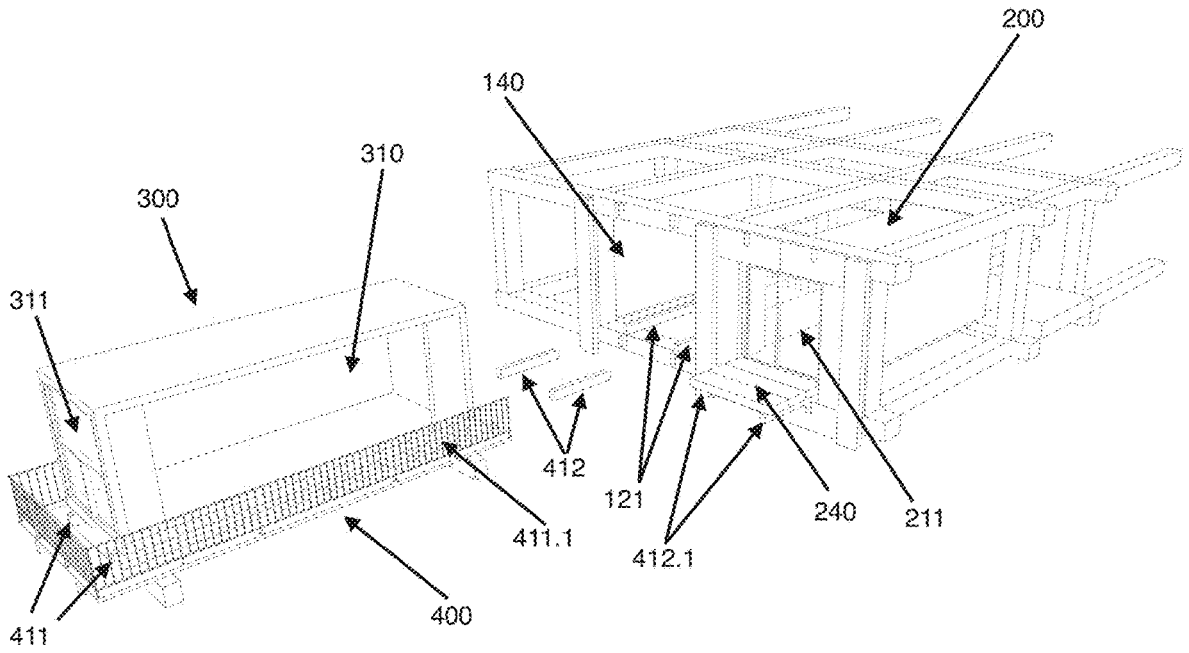
FIGS. 4A-4G are perspective views showing steps of a method for configuring the modular dynamic building structure according to an embodiment of the present disclosure.

Referring first to FIG. 4A, the container 300 is provided on a carriage 400, and the carriage 400 is suspended from above via the crane 10. For example, the carriage 400 may be used multiple times for various containers 200, 300 in a single building 1000 due to the commonality between the containers 200, 300. The container 300 may be loaded onto the carriage 400 on the ground. For example, the crane 10 may set the carriage 400 on the ground, and the container 300 may be pulled onto the carriage 400 via a winch or the like or pushed thereon by workers, a vehicle, etc.

The container 300 (and the container 200) includes a plurality of wheels (see, e.g., wheels 215 in FIG. 3) arranged in a plurality of rows so that it can be easily moved during construction, installation, and removal. For example, in the figures, a two-track movement system is shown which includes two tracks on which the container 300 moves, and the container 300 includes wheels arranged in two corresponding rows to ride on the tracks. However, the movement system is not limited to two tracks and two rows of wheels, and in other embodiments, the movement system may include three or more tracks and a corresponding three or more rows of wheels on the container 300.

The wheels on the container 300 may be cylindrical wheels that do not pivot, such cylindrical roller bearings or the like. Cylindrical roller bearings have good weight bearing properties and help resist unwanted side-to-side movement of the container 300 along the tracks, but such wheels would make the container 300 difficult to rotate on the ground. However, in other embodiments, the container 300 may include caster wheels that allow for easier rotation of the container 300 on the ground. In either embodiment, the carriage 400 and the superstructure 100 may have tracks 411, 121 with a recessed channel into which the wheels fit. For example, the tracks 411 may be connected to the carriage 400, and the tracks 121 may be connected to the superstructure 100 (e.g., may be connected to one or more beams 102 in the superstructure 100). In this way, when the container 300 is on the tracks 411, 121, its lateral movement is restricted by the recessed channels.

In yet other embodiments, the container 300 may have both roller bearings for movement along tracks and retractable caster wheels for movement on the ground. For example, when the container 300 is to be moved along the ground, the caster wheels may be extended to contact the ground and ensure the roller bearings do not contact the ground. Then, once the container 300 has been moved over the tracks 411 on the carriage 400, the caster wheels may be retracted so that the container 300 is supported by the roller bearings on the tracks 411.

Once the container 300 is on the tracks 411 of the carriage 400, the container 300 may be locked in place on the carriage 400 by chocks or other suitable locking mechanisms (e.g., locking pins, etc.). Then, the carriage 400 with the container 300 thereon is lifted by the crane 10 to be aligned with an opening 140 in the superstructure 100 where the container 300 is to be installed. The crane 10 may not only lift the carriage 400 vertically but it may also move laterally along the superstructure 100, such that the container 300 can be loaded onto the carriage 400 at a common location (e.g., a shipping/receiving dock) and then moved to the appropriate location on the building 1000 for installation into the superstructure 100.

Figure 4B:
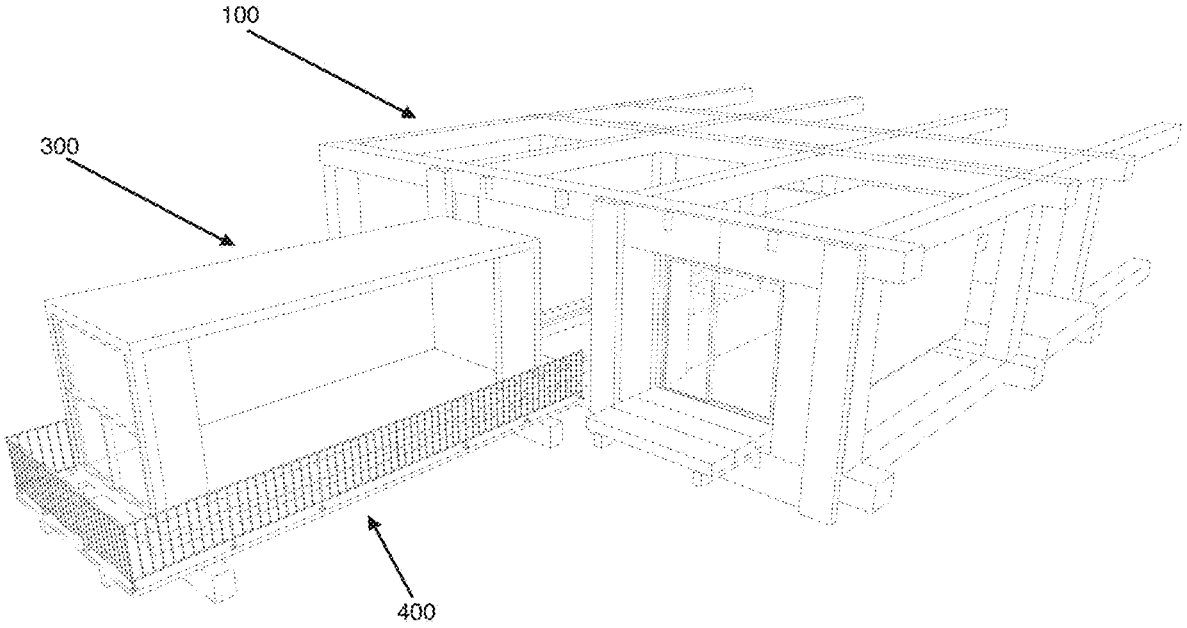

Referring to FIG. 4B, once the carriage 400 with the container 300 thereon is aligned with the opening 140 in the superstructure 100, the carriage 400 is moved by the crane 10 toward the superstructure 100. Once the carriage 400 is close to the superstructure 100, the carriage 400 is connected to superstructure 100 via mounting brackets 414 on the carriage 400 being connected (e.g., by a worker) to corresponding mounting brackets 415 on the superstructure 100 (see, e.g., FIG. 4E). Thus, the carriage 400 is secured to the superstructure 100 and aligns the track 411 on the carriage 400 is aligned with the track 121 in the superstructure 100. At this time, the panels 112, 112.1, 113 are removed if they have not been previously removed. Then, a worker may install track extensions 412 (see, e.g., FIGS. 4A, 4E, 4F, and 5). The track extensions 412 may respectively connect to the tracks 411 on the carriage 400 via track connectors 411.1 and may extend the tracks 411 on the carriage 400 onto the corresponding tracks 121 in the superstructure 100. By using the track extensions 412, the carriage 400 does not have to contact the outer surface of the superstructure 100 (e.g., the panels 111) other than via the mounting brackets 414, 415 to prevent or substantially prevent damage to the building. Further, a worker may connect a winch between the superstructure 100 and the container 300 to pull the container 300 off the carriage 400 and into the superstructure 100 along the tracks 411, 412, and 121.

Figure 4C:
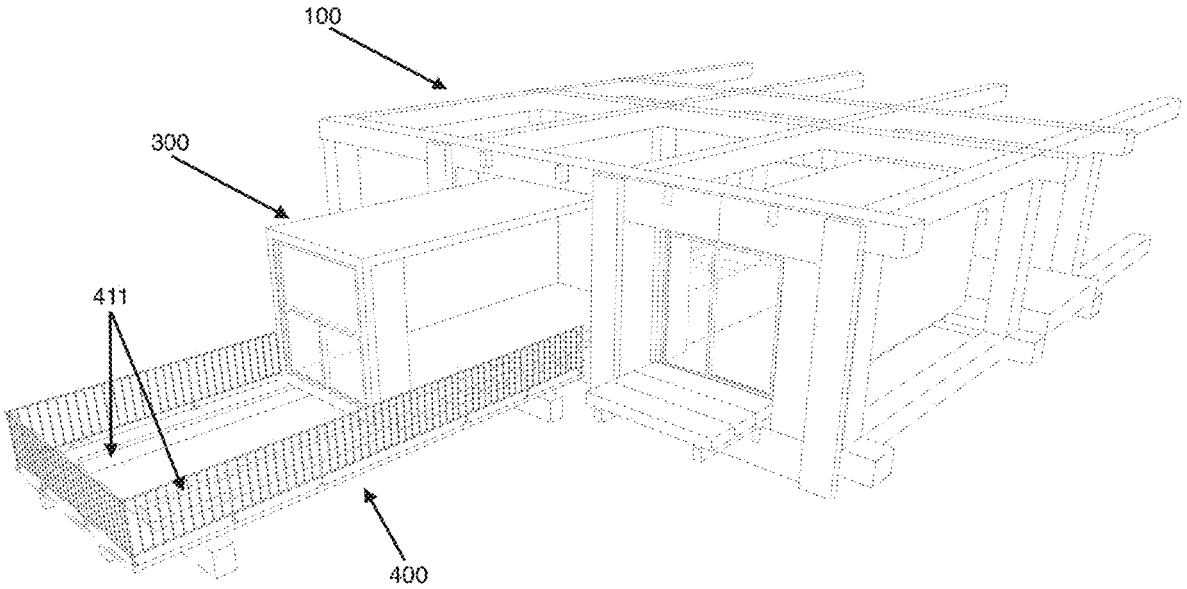

Referring to FIG. 4C, the container 300 is shown in a partially-installed state. For example, after the winch is connected between the container 300 and the superstructure 100, a worker may operate the winch (e.g., manually or electrically operate the winch) to pull the container 300 off the tracks 411 on the carriage 400, over the track extensions 412, and onto the tracks 121 in the superstructure 100.

Figure 4D:
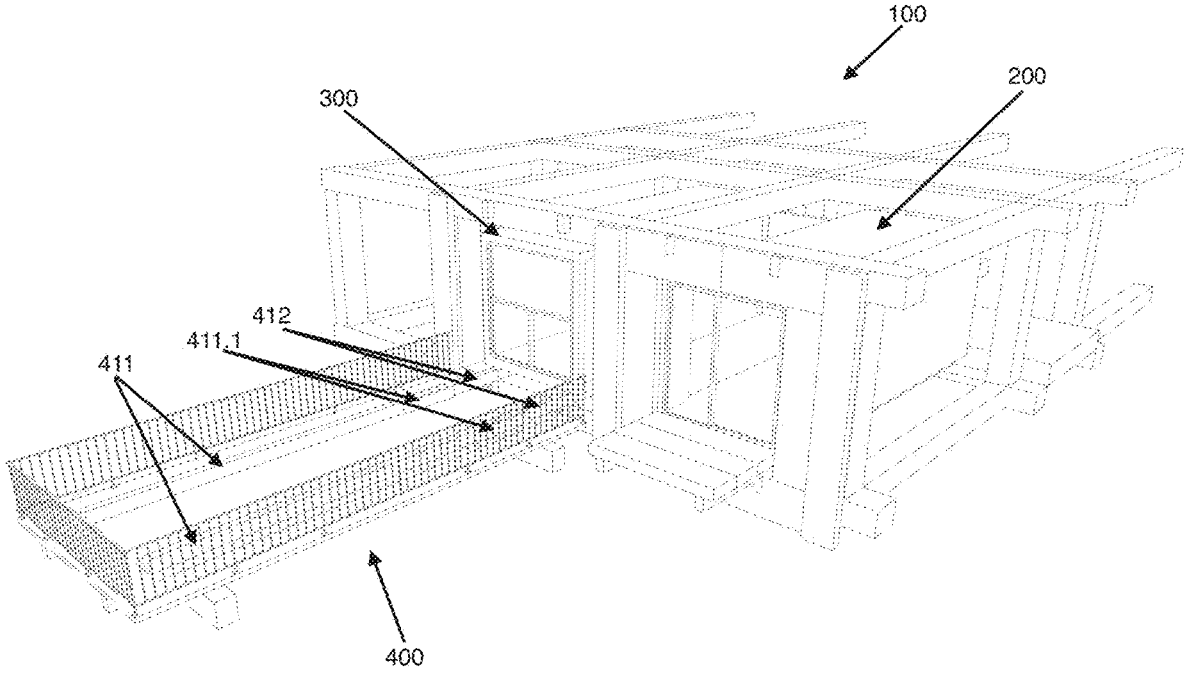
Figure 4E:
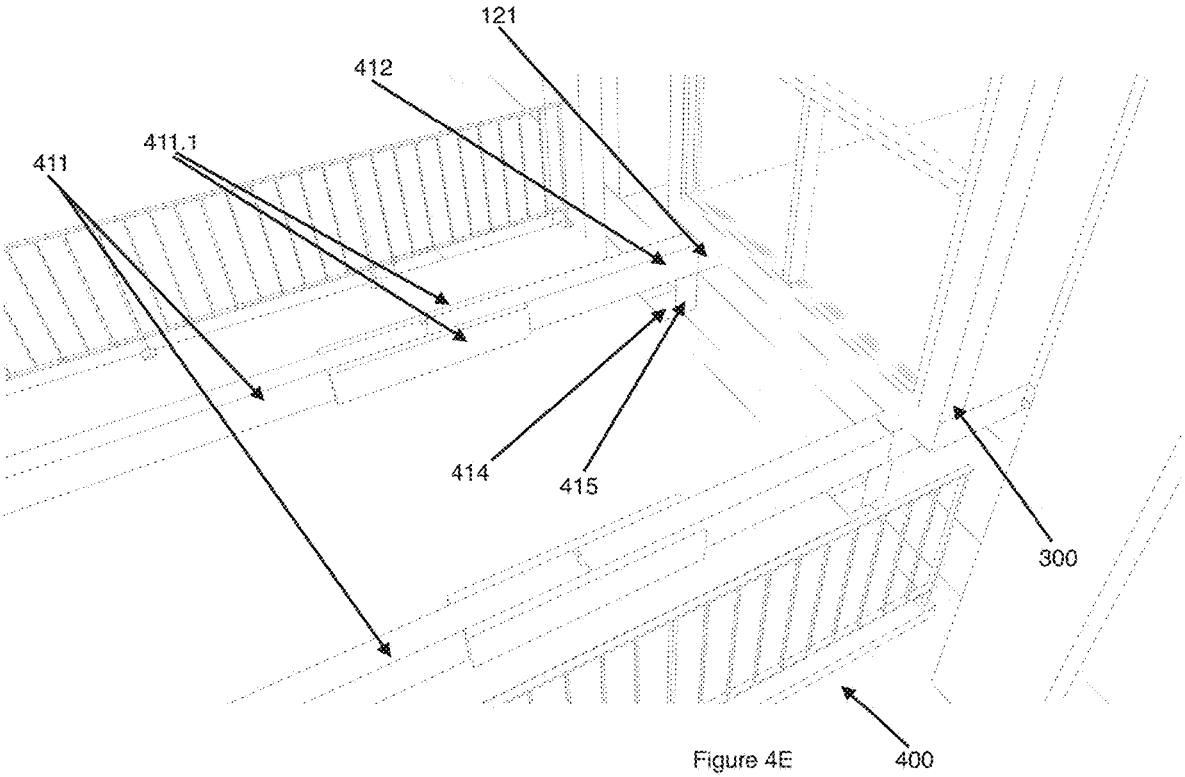

Referring to FIGS. 4D and 4E, the container 300 is shown fully in the superstructure 100 and off the carriage 400. At this time, the track extensions 412 may be removed to disconnect the carriage 400 from the superstructure 100. However, when a balcony (see, e.g., 240 in FIG. 2A) is to installed, the track extensions 412 may be left connected to the tracks 121 onto which the balcony may be installed. In other embodiments, separate deck supports 412.1 may be connected to the superstructure 100 (e.g., connected to the tracks 121) to support the balcony 240. Further, the container 300 may be fixed to the superstructure 100 by any suitable locking mechanism (e.g., locking pins, fixed cable, etc.) to prevent movement of the container 300 relative to the superstructure 100. The utilities connections may also be made between the building 1000 and the container 300 at this time under the removable floor 103. And once the container 300 is locked into the superstructure 100, the containers 200, 300 may be internally connected to each other to form the connected space 250.

Figure 4F:
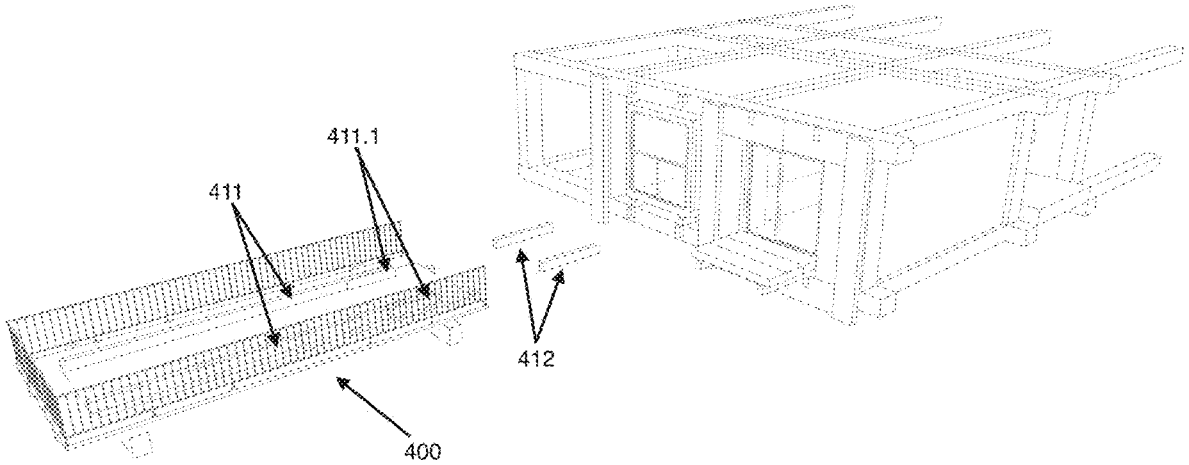
Figure 4G:
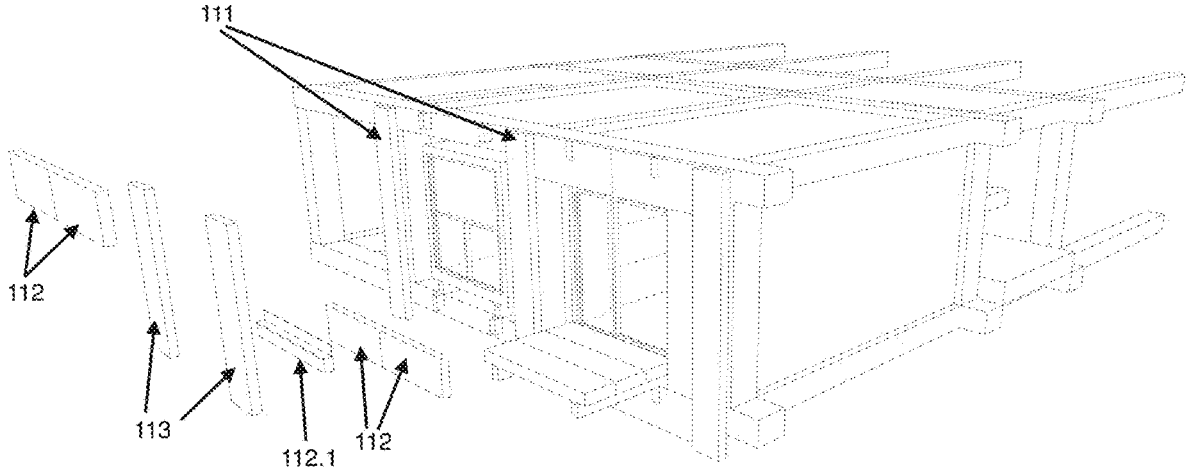
Figure 5:
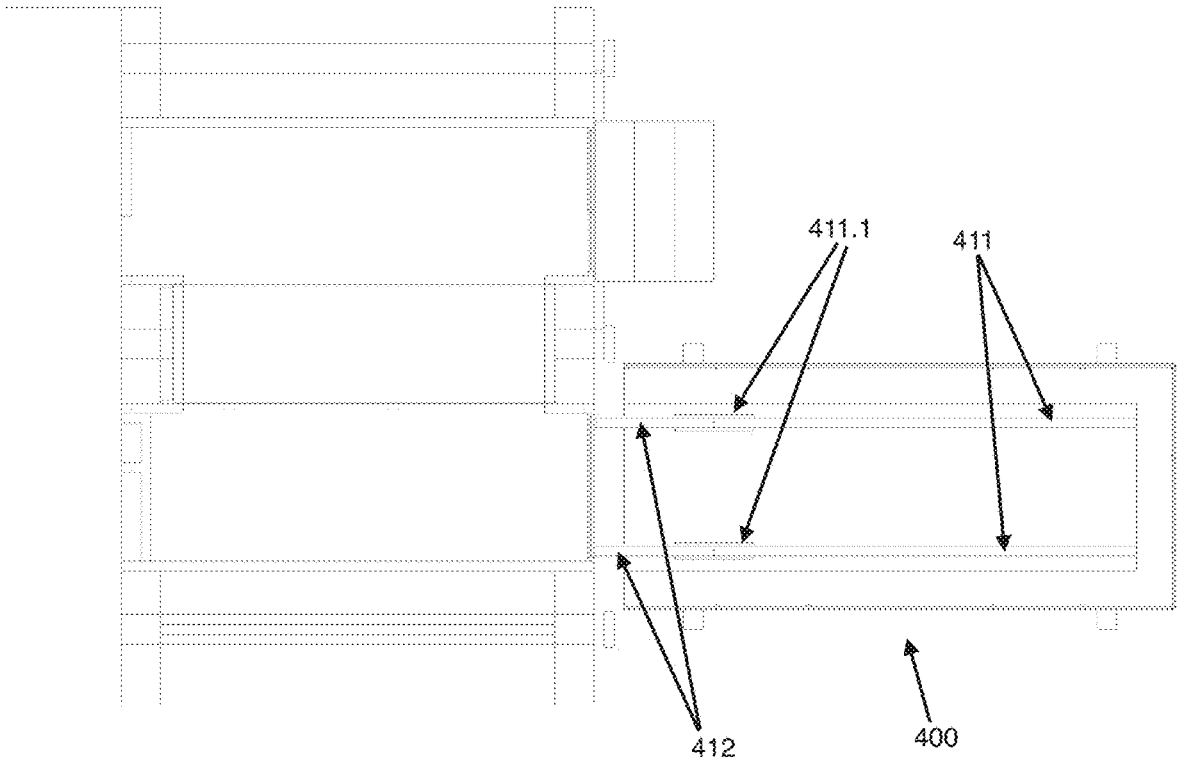
FIG. 5 is a top-down schematic view of FIG. 4D.
Figure 6:
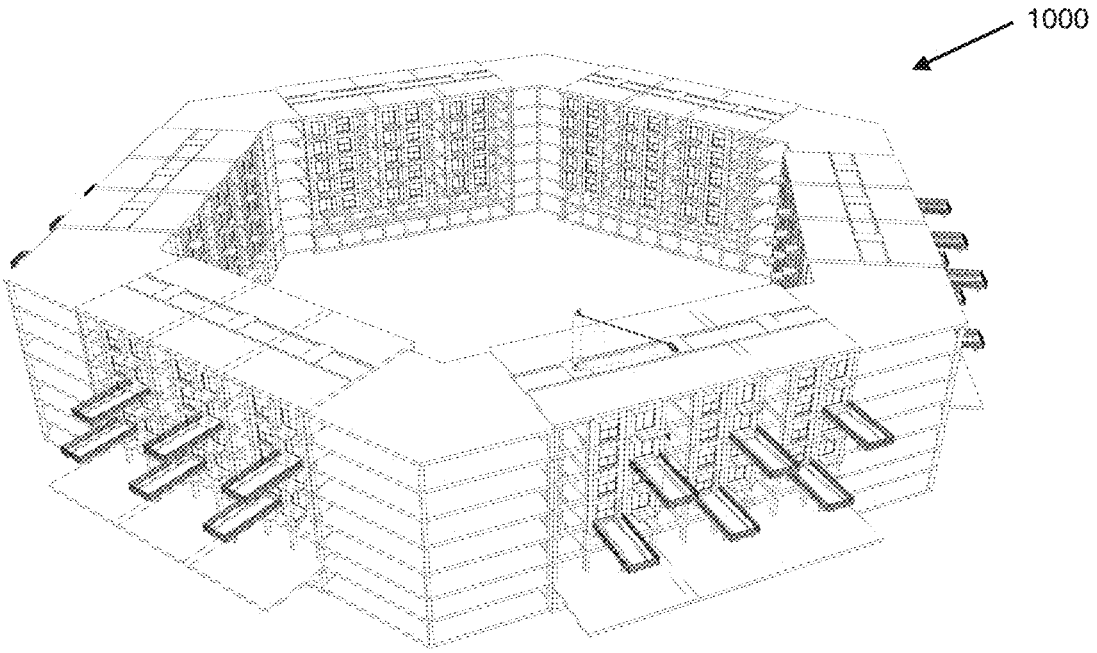
FIG. 6 is a perspective of the modular dynamic building structure shown in FIGS. 1A-1C.
Figure 7:
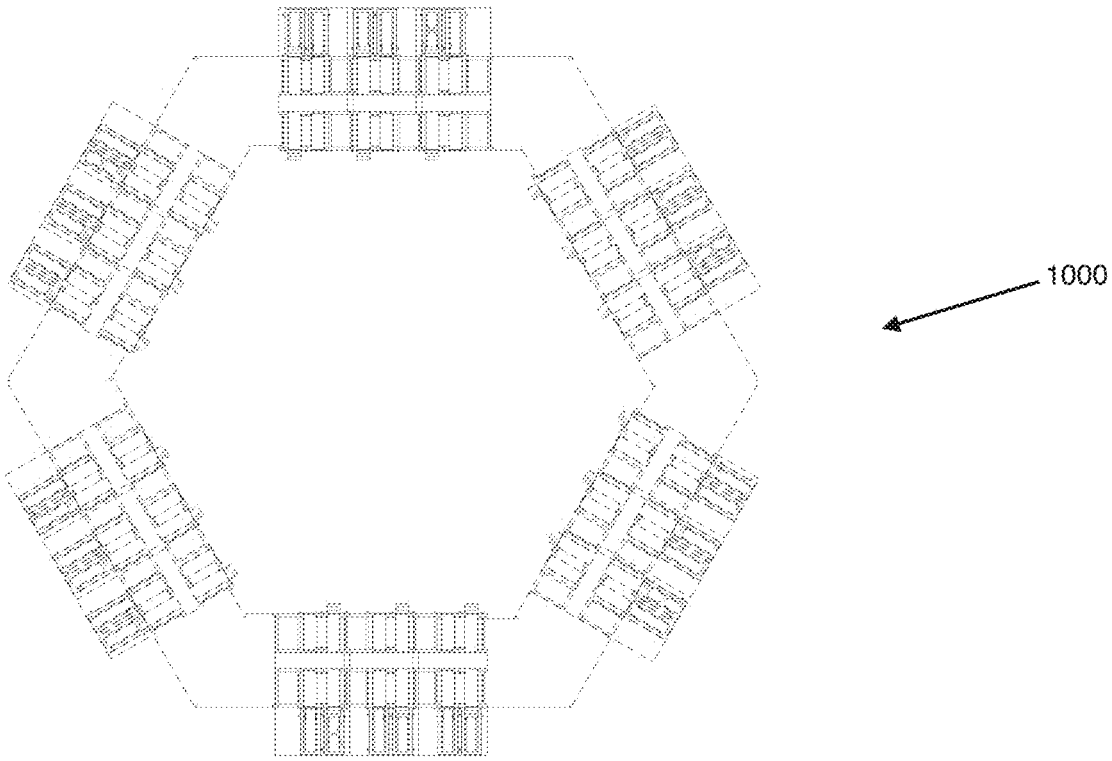
FIG. 7 is a top-down schematic view of the modular dynamic building structure shown in FIG. 6.

Referring to FIGS. 4F and 4G, after the container 300 is fixed to the superstructure 100 and the track extensions 412 are removed, the track cover 112.1 is installed to cover the tracks 121, and the panels 112, 113 are installed around the opening 140 to insulate and weather-seal the container 300 in the building 1000. For example, the panels 112, 113 may be slotted in behind the panels 111 and may be locked into place by any suitable connecting mechanism, for example, snap-fittings, screws, etc. In some embodiments, a worker may install the track cover 112.1 and the panels 112, 113 while standing on the carriage 400.

After the panels 112, 112.1, 113 are installed, the carriage 400 is moved away from the superstructure 100 via the crane 10.

The process of removing the containers 200, 300 from the superstructure 100 may be substantially the opposite as the above-described installation process. For example, first, the panels 112, 113 may be removed and then the track cover 112.1 may be removed from the outside of the building 1000 and the utilities may be disconnected from the container 200, 300. Then, the carriage 400 may be located outside of the superstructure 100 aligned with the container 200, 300, and the track extensions 412 may be installed between the tracks 121 in the superstructure 100 and the tracks 411 on the carriage 400.

Then, the container 200, 300 may be unlocked from the superstructure 100 and either pushed onto the carriage 400 or pulled onto the carriage 400 by, for example, a cable and winch. Once the container 200, 300 is clear of the superstructure 100 and fixed to the carriage 400, the track extensions 412 may be removed. Then, the carriage 400 with the container 200, 300 thereon may be lowered to the ground (e.g., to a shipping/receiving dock) for transport to another building or may be raised to the roof and placed on tracks on the roof so that the container 200, 300 may be easily repositioned on the roof. Alternatively, the container 200, 300 may be moved to another opening in the superstructure 100 and re-installed.

In this way, the building 1000 can not only be quickly assembled, but different continuous spaces therein may be configurable and reconfigurable based on the occupants' desires, needs of the building 1000, etc. For example, if the building 1000 is a residential structure, a new occupant could select a desired combination of containers 200, 300 that has a particular layout, design aesthetic, etc. Then, just prior to the occupant moving in, the selected containers 200, 300 could be installed into the building 1000 as described above. Then, after that occupant moves out, a new occupant could select (e.g., purchase) a new combination of containers that would replace the now-unoccupied containers 200, 300 (e.g., the now-unoccupied containers 200, 300 would be removed and replaced by the new occupant's selected containers), thus providing custom living arrangements in view of each occupant's desires.

In other examples, the building 1000 could be either designed as, for example, a hospital or the building 1000 could be entirely or partially reconfigured from a residential complex to, for example, a hospital when a need for additional hospital beds arose. In such a case, the installed residential-configured containers could be quickly replaced with hospital-configured containers. Different from the residential-configured containers that are configured to be internally connected to each other, each hospital-configured container may be a stand-alone container with a door open to the superstructure 100. In this way, each hospital-configured container could accommodate one or two patients (depending on a level of need) separated from other patients in different containers. Further, because the containers can be built out on the ground and stored in advance, temporary or even permanent hospitals could be built quickly from the ground up or by commandeering residential building using the modular dynamic building system according to the present disclosure.

Figure 8:
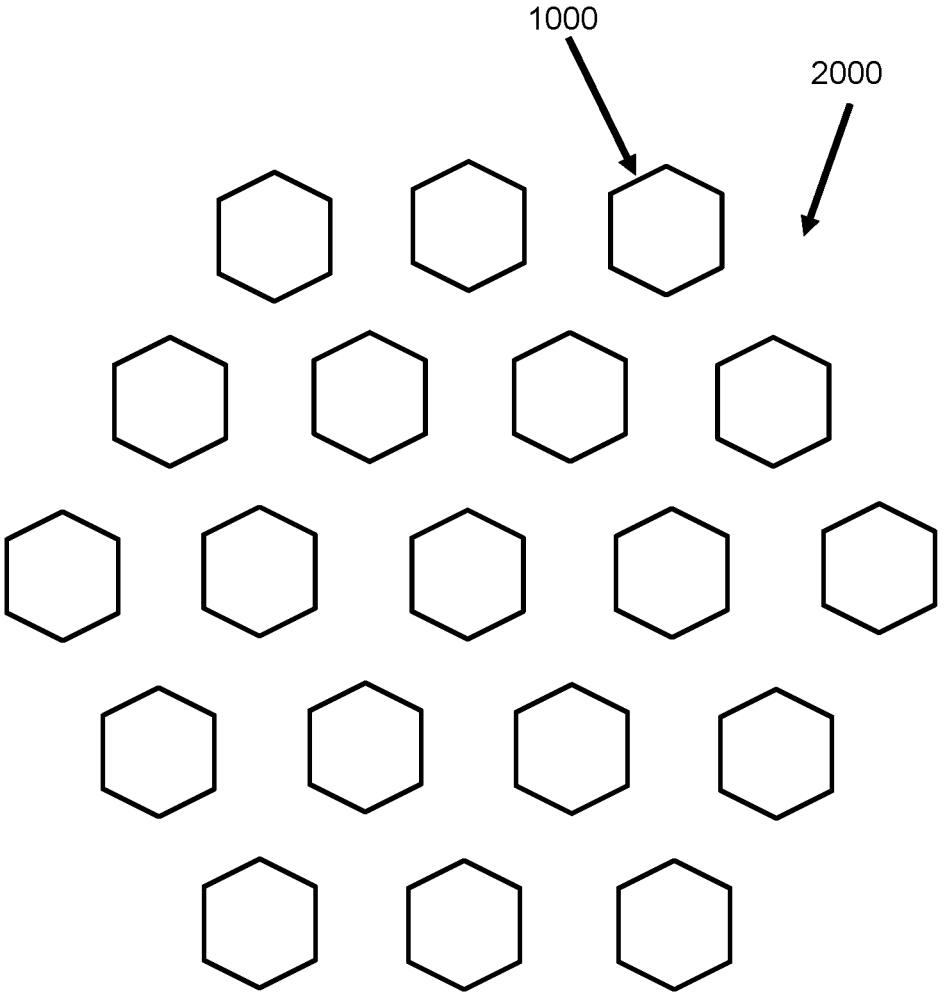
FIG. 8 is a top-down schematic view of a plurality of the modular dynamic building structures shown in FIGS. 1A, 1B, 6, and 7 in a community arrangement.

FIG. 8 shows a top-down schematic view of a community 2000 including a plurality of modular dynamic building structure 1000. Each of the buildings 1000 may have a hexagonal shape which can provide greater sunlight on the North side of the buildings, eliminating ice build-up. Further, buildings 1000 near the center of the community 2000 may be configured as professional buildings (e.g., hospitals, office buildings, schools, places of worship, etc.) while buildings 1000 along the perimeter of the community 2000 may be residential buildings (e.g., mixed residential-light commercial buildings).

Although the present disclosure has been described with reference to the example embodiments, those skilled in the art will recognize that various changes and modifications to the described embodiments may be made, all without departing from the spirit and scope of the present disclosure. Furthermore, those skilled in the various arts will recognize that the present disclosure described herein will suggest solutions to other tasks and adaptations for other applications. It is the applicant's intention to cover, by the claims herein, all such uses of the present disclosure, and those changes and modifications which could be made to the example embodiments of the present disclosure herein chosen for the purpose of disclosure, all without departing from the spirit and scope of the present disclosure. Thus, the example embodiments of the present disclosure should be considered in all respects as illustrative and not restrictive, with the spirit and scope of the present disclosure being indicated by the appended claims and their equivalents.

What is claimed is:

1. A modular dynamic building system comprising:
- a superstructure comprising:
- a plurality of columns;
- a plurality of beams connected to the columns to form an opening into the superstructure; and
- a plurality of tracks connected to the superstructure and in the opening;
- a plurality of containers comprising:
  - a top, a bottom, and a side connecting the top and bottom;
  - a separation panel forming at least one of the top, bottom and side;
  - an opening in one side thereof and a plurality of wheels connected to the bottom of the containers,
- wherein the wheels of each container is on the tracks of the superstructure, and
- wherein the opening in the container faces into the superstructure; and
- a plurality of panels on the superstructure, thereby covering gaps between the superstructure and the containers.

2. The modular dynamic building system of claim 1, further comprising:
- a crane on a roof of the superstructure; and
- a carriage suspended by the crane, the carriage being removably connectable to the superstructure.

3. The modular dynamic building system of claim 2, wherein the carriage comprises a plurality of tracks, the tracks on the carriage corresponding to the tracks in the opening of the superstructure.

4. The modular dynamic building system of claim 3, further comprising a plurality of track extensions, the track extensions being configured to extend the tracks on the carriage to the tracks in the opening of the superstructure.

5. The modular dynamic building system of claim 1, wherein the container further comprises:
- a plurality of columns;
- a plurality of beams connected to the columns, wherein the beams connect the bottom to the side;
- an outer skin covering the columns and beams of the container; and
- an inner skin on an inner surface of the columns and beams of the container.

6. The modular dynamic building system of claim 5, wherein the container is 24 feet long and 9 feet high.

7. The modular dynamic building system of claim 1, further comprising a floor connecting two or more containers, wall panels connected to the floor, and a ceiling connected to the wall panels.

8. The modular dynamic building system of claim 7, wherein the first container, the second container, and the floor define a single, continuous space.

9. A method for configuring a modular dynamic building system, the method comprising:
- moving the container of claim 1 onto a carriage;
- lifting the carriage with the container thereon via a crane to be adjacent an opening in a superstructure;
- moving the container from the carriage into the superstructure;
- locking the container to the superstructure; and
- attaching a panel to the superstructure.

10. The method of claim 9, wherein the crane is on a roof of the superstructure.

11. The method of claim 10, further comprising attaching a plurality of insulating panels around exterior edges of the container in the superstructure.

12. The method of claim 11, wherein the container comprises a plurality of wheels, and wherein the carriage comprises a plurality of corresponding tracks into which the wheels of the container fit.

13. The method of claim 12, further comprising installing a second container into the superstructure at a second opening in the superstructure adjacent to the opening.

14. The method of claim 13, further comprising installing a floor, walls, and a ceiling into a space between the container and the second container.

15. The method of claim 14, wherein the container has an opening into the superstructure.

16. The method of claim 15, wherein both the container and the second container comprise utilities under an inner skin of the container and of the second container.

17. The method of claim 16, further comprising connecting the utilities of the container to building-wide utilities in the superstructure.

18. The method of claim 17, further comprising removing the container from the superstructure.

* * * * *